US008937035B2

(12) United States Patent
Qin et al.

(10) Patent No.: US 8,937,035 B2
(45) Date of Patent: Jan. 20, 2015

(54) STAR POLYMER AND LUBRICATING COMPOSITION THEREOF

(75) Inventors: Haihu Qin, Greer, SC (US); Marina Baum, Chagrin Falls, OH (US); John R. Johnson, Euclid, OH (US)

(73) Assignee: The Lubrizol Corporation, Wickliffe, OH (US)

( * ) Notice: Subject to any disclaimer, the term of this patent is extended or adjusted under 35 U.S.C. 154(b) by 185 days.

(21) Appl. No.: 13/364,425

(22) Filed: Feb. 2, 2012

(65) Prior Publication Data

US 2012/0220506 A1 Aug. 30, 2012

Related U.S. Application Data

(63) Continuation-in-part of application No. PCT/US2011/049120, filed on Aug. 25, 2011.

(60) Provisional application No. 61/378,503, filed on Aug. 31, 2010.

(51) Int. Cl.

| | |
|---|---|
| ***C10M 145/14*** | (2006.01) |
| ***C10M 169/04*** | (2006.01) |
| ***C10M 161/00*** | (2006.01) |

(52) U.S. Cl.

CPC ..... *C10M 145/14* (2013.01); *C10M 161/00* (2013.01); *C10M 2203/1025* (2013.01); *C10M 2205/0285* (2013.01); *C10M 2205/04* (2013.01); *C10M 2207/026* (2013.01); *C10M 2207/028* (2013.01); *C10M 2207/046* (2013.01); *C10M 2207/28* (2013.01); *C10M 2209/084* (2013.01); *C10M 2215/064* (2013.01); *C10M 2215/086* (2013.01); *C10M 2215/224* (2013.01); *C10M 2215/28* (2013.01); *C10M 2223/00* (2013.01); *C10M 2223/043* (2013.01); *C10M 2223/045* (2013.01); *C10M 2223/049* (2013.01); *C10N 2220/021* (2013.01); *C10N 2220/029* (2013.01); *C10N 2220/033* (2013.01); *C10N 2230/02* (2013.01); *C10N 2230/68* (2013.01); *C10N 2240/04* (2013.01); *C10N 2240/042* (2013.01); *C10N 2240/044* (2013.01); *C10N 2240/08* (2013.01); *C10N 2240/10* (2013.01)

USPC ..... 508/469; 508/287

(58) Field of Classification Search

CPC ..... C10M 119/12; C10M 145/14

USPC ..... 508/287, 469

See application file for complete search history.

(56) References Cited

U.S. PATENT DOCUMENTS

| | | | | |
|---|---|---|---|---|
| 5,070,131 | A | 12/1991 | Rhodes et al. | |
| 2007/0244018 | A1 * | 10/2007 | Visger et al. | 508/545 |

FOREIGN PATENT DOCUMENTS

| | | |
|---|---|---|
| EP | 979834 | 2/2000 |
| WO | 9623012 | 8/1996 |
| WO | 2004087850 | 10/2004 |
| WO | 2006047393 | 5/2006 |
| WO | 2006047398 | 5/2006 |
| WO | 2007025837 | 3/2007 |
| WO | 2007127615 | 11/2007 |
| WO | 2007127660 | 11/2007 |
| WO | 2007127661 | 11/2007 |
| WO | 2007127663 | 11/2007 |

OTHER PUBLICATIONS

Search Report from Priority Document PCT/US2011/049120 dated Nov. 7, 2011.

Written Opinion from Priority Document PCT/US2011/049120 dated Nov. 7, 2011.

* cited by examiner

*Primary Examiner* — Prem C Singh

*Assistant Examiner* — Francis C Campanell

(74) *Attorney, Agent, or Firm* — Michael F. Esposito, Esq.; David M. Shold, Esq.

(57) ABSTRACT

The present invention relates to a lubricating composition containing an oil of lubricating viscosity and a star polymer that has at least two inner blocks, at least one of which is in turn bonded to one or more outer blocks. The invention further relates to methods of lubricating a mechanical device with the lubricating composition.

12 Claims, No Drawings

STAR POLYMER AND LUBRICATING COMPOSITION THEREOF

This is a continuation-in-part of PCT Application PCT US2011/049120, Filed 25 Aug., 2011 and designating the U.S., claiming priority from 127660

FIELD OF INVENTION

The present invention relates to a lubricating composition containing an oil of lubricating viscosity and a star polymer that has at least two inner blocks, at least one of which is in turn bonded to one or more outer blocks. The invention further relates to methods of lubricating a mechanical device with the lubricating composition.

BACKGROUND OF THE INVENTION

Viscosity modifiers including star polymers are known in the field of lubricants for providing viscosity index performance, low temperature performance as described by Brookfield viscosity and higher temperature performance as indicated by kinematic viscosity performance at 40° C. and 100° C. The viscosity modifiers performance has been observed in a wide variety of mechanical devices including hydraulic systems, driveline systems and internal combustion engines. The star polymers are described in detail in a number of patent applications.

WO 04/087850 and WO 07/025,837 disclose lubricating composition containing block copolymers prepared from RAFT (Reversible Addition Fragmentation Transfer) or ATRP (Atom Transfer Radical Polymerisation) polymerisation processes.

International Applications WO 06/047393, WO 06/047398, WO 07/127,615 (U.S. 60/745,422), WO 07/127,660 (U.S. 60/745,420), WO 07/127,663 (U.S. 60/745,417), and WO 07/127,661 (U.S. 60/745,425) all disclose RAFT polymers for lubricants. The RAFT polymers provide thickening to a lubricant.

International Application WO 96/23012 discloses star-branched polymers prepared from acrylic or methacrylic monomers. The polymers have a core or nucleus derived from acrylate or methacrylate esters of polyols. Further the polymers have molecular weights and other physical characteristics that make them useful for lubricating oil compositions. The star-branched polymers disclosed are prepared by anionic polymerisation techniques.

The star polymers of EP 979 834 require from 5 to 10 weight percent of a $C_{16-30}$ alkyl(meth)acrylate and from 5 to 15 weight percent of butyl methacrylate. A viscosity index improver with a $C_{16-30}$ alkyl(meth)acrylate monomer present at 5 weight percent or more has reduced low temperature viscosity performance because the polymer has a waxy texture.

U.S. Pat. No. 5,070,131 discloses gear oil compositions having improved shear stability index essentially consisting of gear oil, a viscosity index improver comprising a hydrogenated star polymer comprising at least four arms, the arms comprising, before hydrogenation, polymerized conjugated diolefin monomer units and the arms having a number average molecular weight within the range of 3,000 to 15,000.

The star polymers described in the state of the art are predominately random or tapered block copolymers.

SUMMARY OF THE INVENTION

The inventors of this invention have discovered that a lubricating composition, method and use as disclosed herein is capable of providing at least one of acceptable viscosity index, acceptable fuel economy, acceptable low temperature viscometrics, acceptable oil-solubility, acceptable storage stability.

As used here the number average number of carbons is calculated by:

$$Cn = \frac{\sum[(\text{mol of monomer}) \times (\text{monomer carbon number})]}{\sum(\text{mol of monomer})}$$

The monomer carbon number relates to the number of carbon number of an alkyl group associated the alkyl(meth)acrylate-derived unit described herein.

In one embodiment the invention provides for a lubricating composition comprising an oil of lubricating viscosity and a star polymer, wherein the star polymer comprises a core bonded to at least two inner blocks, at least one of which in turn is bonded to one or more outer blocks, wherein the inner block comprises:

(a) 15 wt % to 90 wt % of a $C_{1-4}$-alkyl(meth)acrylate-derived unit (typically including methyl methacrylate), (b) 10 wt % to 85 wt % of a $C_{4-18}$-alkyl(meth)acrylate-derived unit (or a $C_{5-18}$-alkyl(meth)acrylate-derived unit) different from (a), wherein the (meth)acrylate alkyl group has a number average number of carbons of 1.5 to 8; and (c) 0 wt % to 5 wt % of a vinyl aromatic derived units from a monomer (such as styrene, or vinyl toluene), (typically 0 wt % to 2 wt %, or 0 wt % of a vinyl aromatic unit);

(d) 0 wt % to 5 wt % of a dispersant unit, wherein the dispersant unit is derived from a dispersant monomer, wherein the outer block comprises:

(a) 50 to 95 wt % of a $C_{10-16}$-alkyl(meth)acrylate-derived unit (or $C_{10-15}$-alkyl(meth)acrylate-derived unit), and (b) 5 wt % to 50 wt % of a $C_{1-20}$-alkyl(meth)acrylate-derived unit different from (a) and wherein the outer block is different from the inner block, and (c) 0 wt % to 5 wt % of a dispersant unit, wherein the dispersant unit is derived from a dispersant monomer (typically 0 wt % to 2 wt %, or 0 wt % of a dispersant group), wherein the (meth)acrylate alkyl group has a number average number of carbons of greater than 7 (for example greater than 7 up to either 16, or 13. The number average number of carbons may be greater than 7 to 16, or 8 to 13), and (d) 0 wt % to 5 wt % of a vinyl aromatic derived units from a monomer (such as styrene, or vinyl toluene); and wherein the difference in the number average number of carbon atoms between the alkyl groups of the inner block and the alkyl groups of the outer block is at least 0.8 and wherein the number average number of carbon atoms in the alkyl groups of the inner block is less than the average number of carbon atoms in the alkyl groups of the outer block.

In one embodiment, the star polymer comprises a core bonded to at least two inner blocks, at least one of which in turn is bonded to one or more outer blocks, also known as a block arm star, is such that at least one arm has both an inner block and an outer block (a block arm).

The block arm(s) of the block arm star polymer of the present invention have an inner block and an outer block, wherein the ratio of the inner and outer block may be sufficient to render the block arm star polymer oil soluble. The block arm(s) of the block arm star may have an inner block and an outer block wherein the ratio of the inner and outer blocks may be 5:95 to 95:5 by weight. In other embodiments, the ratio of the inner block to the outer block of the block arm may be 10:90 to 90:10, or 20:80 to 80:20, or 30:70 to 70:30 by weight. In one embodiment the ratio of the inner block to the outer block may be 95:5 to 40:60 by weight. In one embodiment, the ratio of the inner block to the outer block may be 20:80 to 80:20. In one embodiment, the ratio of the inner block to the outer block may be 40:60 to 5:95 by weight.

In different embodiments the block arm star polymer of the present invention may have at least 2 block arms, or at least 3 block arms, or at least 4 block arms, or at least 6 block arms. In one embodiment at least 25% of the star polymer arms may be block arms. In different embodiments, at least 40% of the polymer arms are block arms, or at least 50% of the arms may be block arms, or at least 75% of the arms may be block arms. In one embodiment, the block arm star polymer consists of block arms.

The difference in the number average number of carbon atoms of the alkyl groups of the alkyl(meth)acrylate-derived units described herein between the inner block and outer block is at least 0.8, and may be at least 1.2, or at least 2.0, or at least 2.8. The upper range may include up to 10, or up to 8, or up to 6. Specific ranges may include 0.8 to 8 or 2 to 5).

Typically the (meth)acrylate-derived units are methacrylate-derived units, or mixtures thereof.

In one embodiment the star polymer comprises 0 wt % to 2 wt % of a dispersant unit and 0 wt % to 2 wt % of a vinyl aromatic unit.

In one embodiment the star polymer comprises 0 wt % of a dispersant unit and 0 wt % of a vinyl aromatic unit.

In one embodiment the star polymer disclosed herein contains 0 wt % of a dispersant unit.

In one embodiment the invention provides for a lubricating composition comprising an oil of lubricating viscosity and a star polymer, wherein the star polymer comprises a core bonded to at least two inner blocks, at least one of which in turn is bonded to one or more outer blocks, (a) 20 wt % to 90 wt % of a $C_{1-4}$-alkyl(meth)acrylate-derived unit, (b) 10 wt % to 80 wt % of a $C_{5-18}$-alkyl(meth)acrylate-derived unit, wherein the (meth)acrylate alkyl group of the inner block has a number average number of carbons of 1.5 to 8; and (c) 0 wt % of a vinyl aromatic derived unit from a monomer;

(d) 0 wt % of a dispersant unit dispersant unit derived from a dispersant monomer, wherein at least one outer block comprises:

(a) 50 to 95 wt % of a $C_{10-16}$-alkyl(meth)acrylate-derived unit (or $C_{10-15}$-alkyl(meth)acrylate-derived unit), and (b) 5 wt % to 50 wt % of a $C_{1-20}$-alkyl methacrylate-derived unit different from (a) and wherein the outer block is different from the inner block, and (c) 0 wt % of a dispersant unit, wherein the dispersant unit is derived from a dispersant monomer, wherein the (meth)acrylate alkyl group of the outer block has a number average number of carbons of greater than 7, and (d) 0 wt % of a vinyl aromatic derived unit from a monomer; and wherein the difference in the number average number of carbon atoms in the alkyl groups of the inner block and the number average number of carbon atoms in the alkyl groups of the outer block is 0.8 to 8, or 2 to 5;

and wherein the number average number of carbon atoms in the alkyl groups of the inner block is less than the number average number of carbon atoms in the alkyl groups of the outer block.

In one embodiment each (meth)acrylate unit disclosed herein is a methacrylate unit.

In one embodiment the invention provides a method of lubricating a mechanical device comprising supplying to the mechanical device a lubricating composition disclosed herein. The mechanical device may be an internal combustion engine, a hydraulic device, a manual or automatic transmission, industrial gear, an automotive gear (or axle fluid), or a farm tractor.

In one embodiment the invention provides for the use of a star polymer that has at least two inner blocks, at least one of which is in turn bonded to one or more outer blocks disclosed herein in a lubricating composition to provide at least one of acceptable viscosity index, acceptable fuel economy, acceptable low temperature viscometrics, acceptable oil-solubility, acceptable storage stability. In one embodiment the star polymer provides acceptable oil-solubility or acceptable storage stability.

DETAILED DESCRIPTION OF THE INVENTION

The present invention provides a lubricating composition, a method for lubricating as disclosed above, and a use of the star polymer as disclosed above.

Star Polymer

As used herein terms such as "the star polymer has (or contains) monomers composed of" means the star polymer comprises units derived from the particular monomer referred to.

As used herein the term "(meth)acryl" means acryl or methacryl.

The star polymer may be prepared by a number of polymerisation processes known in the art. The polymerisation process may be a free radical polymerisation such as anionic polymerisation, or a controlled free radical polymerisation such as RAFT (Reversible Addition Fragmentation Transfer), or ATRP (Atom Transfer Radical Polymerisation), or nitroxide-mediated polymerisation. In one embodiment the star polymer may be obtained/obtainable from RAFT, ATRP or anionic polymerisation processes. In one embodiment the star polymer may be obtained/obtainable from RAFT or ATRP polymerisation processes. In one embodiment the star polymer may be obtained/obtainable from a RAFT polymerisation process.

More detailed descriptions of polymerisation mechanisms and related chemistry is discussed for nitroxide-mediated polymerisation (Chapter 10, pages 463 to 522), ATRP (Chapter 11, pages 523 to 628) and RAFT (Chapter 12, pages 629 to 690) in the Handbook of Radical Polymerization, edited by Krzysztof Matyjaszewski and Thomas P. Davis, 2002, published by John Wiley and Sons Inc (hereinafter referred to as "Matyjaszewski et al.").

When the star polymer is derivable from a RAFT polymerisation, chain transfer agents are important. A more detailed review of suitable chain transfer agents is found in paragraphs 66 to 71 of WO 06/047393. Examples of a suitable RAFT chain transfer agent include benzyl 1-(2-pyrrolidinone)carbodithioate, benzyl(1,2-benzenedicarboximido) carbodithioate, 2-cyanoprop-2-yl 1-pyrrolecarbodithioate, 2-cyanobut-2-yl 1-pyrrolecarbodithioate, benzyl 1-imidazolecarbodithioate, N,N-dimethyl-S-(2-cyanoprop-2-yl)dithiocarbamate, N,N-diethyl-5-benzyl dithiocarbamate, cyanomethyl 1-(2-pyrrolidone) carbodithoate, cumyl dithiobenzoate, 2-dodecylsulphanylthiocarbonylsulphanyl-2-methyl-propionic acid butyl ester, O-phenyl-5-benzyl xanthate, N,N-diethyl S-(2-ethoxy-carbonylprop-2-yl)dithiocarbamate, dithiobenzoic acid, 4-chlorodithiobenzoic acid, O-ethyl-S-(1-phenylethyl)xanthtate, O-ethyl-S-(2-(ethoxycarbonyl)prop-2-yl)xanthate, O-ethyl-S-(2-cyanoprop-2-yl)

xanthate, O-ethyl-S-(2-cyanoprop-2-yl)xanthate, O-ethyl-5-cyanomethyl xanthate, O-pentafluorophenyl-5-benzyl xanthate, 3-benzylthio-5,5-dimethylcyclohex-2-ene-1-thione or benzyl 3,3-di(benzylthio)-prop-2-enedithioate, S,S'-bis-(α,α'-disubstituted-α"-acetic acid)-trithiocarbonate, S,S'-bis-(α,α'-disubstituted-α"-acetic acid)-trithiocarbonate or S-alkyl-S'-(α,α'-disubstituted-α"-acetic acid)-trithiocarbonates, benzyl dithio-benzoate, 1-phenylethyl dithiobenzoate, 2-phenylprop-2-yl dithiobenzoate, 1-acetoxyethyl dithiobenzoate, hexakis-(thiobenzoylthiomethyl)benzene, 1,4-bis(thiobenzoyl-thiomethyl)-benzene, 1,2,4,5-tetrakis (thiobenzoylthio-methyl)-benzene, 1,4-bis(2-(thiobenzoylthio)prop-2-yl)benzene, 1-(4-meth-oxyphenyl)ethyl dithiobenzoate, benzyl dithioacetate, ethoxycarbonylmethyl dithioacetate, 2-(ethoxycarbonyl)prop-2-yl dithiobenzoate, 2,4,4-trimethylpent-2-yl dithio-benzoate, 2-(4-chlorophenyl)-prop-2-yl dithiobenzoate, 3-vinylbenzyl dithiobenzoate, 4-vinylbenzyl dithiobenzoate, S-benzyl diethoxyphosphinyldithioformate, tert-butyl trithioperbenzoate, 2-phenylprop-2-yl 4-chlorodithio-benzoate, 2-phenylprop-2-yl 1-dithionaphthalate, 4-cyanopentanoic acid dithiobenzoate, dibenzyl tetrathioterephthalate, dibenzyl trithiocarbonate, carboxymethyl dithiobenzoate or poly(ethylene oxide) with dithiobenzoate end group or mixtures thereof. In one embodiment a suitable RAFT chain transfer agent includes 2-dodecylsulphanylthiocarbonylsulphanyl-2-methyl-propionic acid butyl ester, cumyl dithiobenzoate or mixtures thereof.

The discussion of the polymer mechanism of ATRP polymerisation is shown on page 524 in reaction scheme 11.1, page 566 reaction scheme 11.4, reaction scheme 11.7 on page 571, reaction scheme 11.8 on page 572 and reaction scheme 11.9 on page 575 of Matyjaszewski et al.

In ATRP polymerisation, groups that may be transferred by a radical mechanism include halogens (from a halogen-containing compound) or various ligands. A more detailed review of groups that may be transferred is described in U.S. Pat. No. 6,391,996.

Reagents and polymerisation conditions suitable to prepare the star polymer of the present invention are also described in WO 04/087850) and WO 07/025,837.

The star polymer may be prepared by an arm-first process or core-first process. By arm-first it is meant that the alkyl (meth)acrylate-derived units are copolymerised before condensing with a polyol, a polyvalent unsaturated (meth)acrylic monomer, or mixtures thereof. A core-first process means that the core is formed before copolymersing the alkyl(meth) acrylate-derived units as defined above. Both the arm-first process and the core-first process are known to a person skilled in the art. Typically, the star polymer of the present invention may be formed by an arm-first process.

The star polymer may be prepared by condensing with a polyol, a polyvalent unsaturated (meth)acrylic monomer, or mixtures thereof. The polyol may contain 2 to 20, or 3 to 15, or 4 to 12 carbon atoms; and the number of hydroxyl groups present may be 2 to 10, or 2 to 4, or 2. Examples of polyols include ethylene glycol, poly(ethylene glycols), alkane diols such as 1,6-hexane diol or triols such as trimethylolpropane, oligomerised trimethylolpropanes such as Boltorn® materials sold by Perstorp Polyols. Examples of polyamines include polyalkylenepolyamines such as ethylenediamine, diethylenetriamine, triethylenetetramine, tetraethylene pentamine, pentaethylenehexamine and mixtures thereof.

Examples of the polyvalent unsaturated (meth)acrylic monomer include ethylene glycol diacrylate, ethylene glycol di(meth)acrylate, diethylene glycol diacrylate, diethylene glycol di(meth)acrylate, glycerol diacrylate, glycerol triacrylate, mannitol hexaacrylate, 4-cyclohexanediol diacrylate, 1,4-benzenediol di(meth)acrylate, neopentylglycol diacrylate, 1,3-propanediol diacrylate, 1,5-pentanediol di(meth) acrylate, bis-acrylates and bis-(meth)acrylates of polyethylene glycols of molecular weight 200-4000, polycaprolactonediol diacrylate, 1,1,1-trimethylolpropane diacrylate, 1,1,1-trimethylolpropane triacrylate, pentaerythritol diacrylate, pentaerythritol triacrylate, pentaerythritol tetraacrylate, triethylene glycol diacrylate, triethylene glycol di(meth)acrylate, 1,1,1-trimethylolpropane tri(meth)acrylate, hexamethylenediol diacrylate or hexamethylenediol di(meth)acrylate or an alkylene bis-(meth)acrylamide.

The amount of coupling agent may be an amount suitable to provide coupling of polymer previously prepared as arms onto a core comprising the coupling agent in monomeric, oligomeric, or polymeric form, to provide a star polymer. As described above, suitable amounts may be determined readily by the person skilled in the art with minimal experimentation, even though several variables may be involved. For example, if an excessive amount of coupling agent is employed, or if excessive unreacted monomer from the formation of the polymeric arms remains in the system, crosslinking rather than star formation may occur. Typically the mole ratio of polymer arms to coupling agent may be 50:1 to 1.5:1 (or 1:1), or 30:1 to 2:1, or 10:1 to 3:1, or 7:1 to 4:1, or 4:1 to 1:1. In other embodiments the mole ratio of polymer arms to coupling agent may be 50:1 to 0.5:1, or 30:1 to 1:1, or 7:1 to 2:1. The desired ratio may also be adjusted to take into account the length of the arms, longer arms sometimes tolerating or requiring more coupling agent than shorter arms. Typically the material prepared is soluble in an oil of lubricating viscosity.

The overall composition containing star polymers may also have uncoupled polymeric arms present (also referred to as a polymer chain or linear polymer). The percentage conversion of a polymer chain to star polymer may be at least 10%, or at least 20%, or at least 40%, or at least 55%, for instance at least 70%, at least 75% or at least 80%. In one embodiment the conversion of polymer chain to star polymer may be 90%, 95% or 100%. In one embodiment a portion of the polymer chains does not form a star polymer and remains as a linear polymer. In one embodiment the star polymer is in the form of a mixture with linear polymer chains (also referred to as uncoupled polymeric arms). In different embodiments the amount of star polymer composition may be 10 wt % to 85 wt %, or 25 wt % to 70 wt % of the amount of polymer. In different embodiments the linear polymer chains may be present at 15 wt % to 90 wt %, or 30 wt % to 75 wt % of the amount of RAFT polymer.

The star polymer may have 2 or more arms, or 5 or more arms, or 7 or more arms, or 10 or more arms, for instance 3 to 100, or 4 to 50, or 6 to 30, or 8 to 14 arms. The star polymer may have 120 arms or less, or 80 arms or less, or 60 arms or less.

The alkyl(meth)acrylate-derived units described by the present invention may be monomers derived from saturated alcohols, such as methyl(meth)acrylate, ethyl(meth)acrylate, propyl(meth)acrylate, butyl(meth)acrylate, 2-methylpentyl (meth)acrylate, 2-propylheptyl(meth)acrylate, 2-butyloctyl (meth)acrylate, 2-ethylhexyl(meth)acrylate, octyl(meth) acrylate, nonyl(meth)acrylate, isooctyl(meth)acrylate, isononyl(meth)acrylate, 2-tert-butylheptyl(meth)acrylate, 3-isopropylheptyl(meth)acrylate, decyl(meth)acrylate, undecyl(meth)acrylate, 5-methylundecyl(meth)acrylate, dodecyl (meth)acrylate, 2-methyldodecyl(meth)acrylate, tridecyl (meth)-acrylate, 5-methyltridecyl(meth)acrylate, tetradecyl (meth)acrylate, pentadecyl(meth)acrylate, hexadecyl(meth) acrylate, 2-methylhexadecyl(meth)acrylate, heptadecyl (meth)acrylate, 5-isopropylheptadecyl(meth)acrylate, 4-tert-butyloctadecyl(meth)acrylate, 5-ethyloctadecyl(meth)acrylate, 3-isopropyl-octadecyl-(meth)acrylate, octadecyl (meth)acrylate, nonadecyl(meth)acrylate, eicosyl(meth)acrylate, (meth)acrylates derived from unsaturated alcohols, such as oleyl(meth)acrylate; and cycloalkyl(meth)acrylates, such as 3-vinyl-2-butylcyclohexyl(meth)acrylate or bornyl (meth)acrylate.

The alkyl(meth)acrylates with long-chain alcohol-derived groups may be obtained, for example, by reaction of a (meth) acrylic acid (by direct esterification) or methyl(meth)acrylate (by transesterification) with long-chain fatty alcohols, in which reaction a mixture of esters such as (meth)acrylate with alcohol groups of various chain lengths is generally obtained. These fatty alcohols include Oxo Alcohol® 7911, Oxo Alcohol® 7900 and Oxo Alcohol® 1100 of Monsanto; Alphanol® 79 of ICI; Nafol® 1620, Alfol® 610 and Alfol® 810 of Condea (now Sasol); Epal® 610 and Epal® 810 of Ethyl Corporation; Linevol® 79, Linevol® 911 and Dobanol® 25 L of Shell AG; Liar) 125 of Condea Augusta, Milan; Dehydad® and Lorol® of Henkel KGaA (now Cognis) as well as Linopol® 7-11 and Acropol® 91 of Ugine Kuhlmann.

In one embodiment the star polymer of the invention includes a dispersant unit derived from a monomer. The dispersant unit may be derived from a nitrogen-containing compound or an oxygen-containing compound, or mixtures thereof. The dispersant unit may have a carbonyl group in combination with a basic nitrogen or hydroxy-group.

The oxygen-containing compound may include hydroxyalkyl(meth)acrylates such as 3-hydroxypropyl(meth)acrylate, 3,4-dihydroxybutyl(meth)acrylate, 2-hydroxyethyl (meth)acrylate, 2-hydroxypropyl(meth)acrylate, 2,5-dimethyl-1,6-hexanediol(meth)acrylate, 1,10-decanediol (meth)acrylate, carbonyl-containing (meth)acrylates such as 2-carboxyethyl(meth)acrylate, carboxymethyl(meth)acrylate, oxazolidinylethyl(meth)acrylate, N-(methacryloyloxy) formamide, acetonyl(meth)acrylate, N-methacryloylmorpholine, N-methacryloyl-2-pyrrolidinone, N-(2-methacryloyl-oxyethyl)-2-pyrrolidinone, N-(3-methacryloyloxypropyl)-2-pyrrolidinone, N-(2-methacryloyloxypentadecyl)-2-pyrrolidinone, N-(3-methacryloyloxy-heptadecyl)-2-pyrrolidinone; glycol di(meth)acrylates such as 1,4-butanediol(meth)acrylate, 2-butoxyethyl(meth)acrylate, 2-ethoxyethoxymethyl(meth) acrylate, 2-ethoxyethyl(meth)acrylate, or mixtures thereof.

Other examples of suitable non-carbonyl oxygen containing compounds capable of being incorporated into the copolymer include (meth)acrylates of ether alcohols, such as tetrahydrofurfuryl(meth)acrylate, vinyloxyethoxyethyl (meth)acrylate, methoxyethoxyethyl(meth)acrylate, 1-butoxypropyl(meth)acrylate, 1-methyl-(2-vinyloxy)ethyl (meth)acrylate, cyclo-hexyloxymethyl(meth)acrylate, methoxymethoxyethyl(meth)acrylate, benzyloxymethyl (meth)acrylate, furfuryl(meth)acrylate, 2-butoxyethyl(meth) acrylate, 2-ethoxyethoxymethyl(meth)acrylate, 2-ethoxyethyl(meth)acrylate, allyloxymethyl(meth)acrylate, 1-ethoxybutyl(meth)acrylate, methoxymethyl(meth)acrylate, 1-ethoxyethyl(meth)acrylate, ethoxymethyl(meth)acrylate and ethoxylated(meth)acrylates which typically have 1 to 20, or 2 to 8, ethoxy groups, or mixtures thereof. In one embodiment the non-carbonyl oxygen containing compounds capable of being incorporated into the copolymer may be a methacrylate.

The nitrogen-containing compound may include a vinyl-substituted nitrogen heterocyclic monomer, a dialkylaminoalkyl(meth)acrylate monomer, a dialkylaminoalkyl(meth) acrylamide monomer, a tertiary-alkyl(meth)acrylamide monomer or mixtures thereof. In one embodiment the RAFT polymer is not further functionalised in the core or the polymeric arms with a nitrogen-containing monomer.

The nitrogen-containing compound may be a (meth)acrylamide or a nitrogen containing (meth)acrylate monomer that may be represented by the formula:

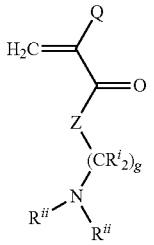

wherein Q may be hydrogen or methyl and, in one embodiment Q is methyl; Z may be an N—H group or O (oxygen); each may independently be hydrogen or a hydrocarbyl group (typically alkyl) containing 1 to 8, or 1 to 4 carbon atoms;

each $R^i$ may independently be hydrogen or a hydrocarbyl group (typically alkyl) containing 1 to 2 carbon atoms, and typically hydrogen; and g may be an integer from 1 to 6, or 1 to 3.

Examples of a suitable nitrogen-containing compound include N,N-dimethylacrylamide, N-vinyl carbonamides such as N-vinyl-formamide, vinyl pyridine, N-vinylacetoamide, N-vinyl propionamides, N-vinyl hydroxy-acetoamide, N-vinyl imidazole, N-vinyl pyrrolidinone, N-vinyl caprolactam, dimethylaminoethyl acrylate (DMAEA), dimethylaminoethyl methacrylate (DMAEMA), dimethylaminobutyl acrylamide, dimethylaminopropyl methacrylate (DMAPMA), dimethylaminopropyl acrylamide, dimethylaminopropyl methacrylamide, dimethylaminoethyl acrylamide or mixtures thereof.

Generally, the star polymer of the invention may be present in the lubricant at ranges including 0.01 wt % to 60 wt %, or 0.5 wt % to 60 wt % of the lubricating composition.

Oils of Lubricating Viscosity

The lubricating composition comprises an oil of lubricating viscosity. Such oils include natural and synthetic oils, oil derived from hydrocracking, hydrogenation, and hydrofinishing, unrefined, refined, re-refined oils or mixtures thereof. A more detailed description of unrefined, refined and re-refined oils is provided in International Publication WO2008/147704, paragraphs [0054] to [0056]. A more detailed description of natural and synthetic lubricating oils is described in paragraphs [0058] to [0059] respectively of WO2008/147704. Synthetic oils may also be produced by Fischer-Tropsch reactions and typically may be hydroisomerised Fischer-Tropsch hydrocarbons or waxes. In one embodiment oils may be prepared by a Fischer-Tropsch gas-to-liquid synthetic procedure as well as other gas-to-liquid oils.

Oils of lubricating viscosity may also be defined as specified in April 2008 version of "Appendix E—API Base Oil Interchangeability Guidelines for Passenger Car Motor Oils and Diesel Engine Oils", section 1.3 Sub-heading 1.3. "Base Stock Categories". In one embodiment the oil of lubricating viscosity may be an API Group II or Group III oil. The oil of lubricating viscosity may also be an ester.

The amount of the oil of lubricating viscosity present is typically the balance remaining after subtracting from 100 wt % the sum of the amount of the compound of the invention and the other performance additives.

The lubricating composition may be in the form of a concentrate and/or a fully formulated lubricant. If the star polymer of the present invention, is in the form of a concentrate (which may be combined with additional oil to form, in whole or in part, a finished lubricant), the ratio of the of components the star polymer of the present invention to the oil of lubricating viscosity and/or to diluent oil include the ranges of 1:99 to 99:1 by weight, or 80:20 to 10:90 by weight.

Other Performance Additive

The composition of the invention optionally further includes at least one other performance additive. The other performance additives include metal deactivators, detergents, viscosity index improvers (that is, viscosity modifiers other than the star polymer of the present invention), extreme pressure agents (typically sulphur- and/or phosphorus-containing), antiwear agents, antioxidants (such as hindered phenols, aminic antioxidants (typically dinonyl diphenylamine, octyl diphenylamine, dioctyl diphenylamine), or molybdenum compounds), corrosion inhibitors, foam inhibitors, demulsifiers, pour point depressants, seal swelling agents, friction modifiers, and mixtures thereof.

The hindered phenol may include 2,6-di-tert-butylphenol, 4-methyl-2,6-di-tert-butylphenol, 4-ethyl-2,6-di-tert-butylphenol, 4-propyl-2,6-di-tert-butylphenol or 4-butyl-2,6-di-tert-butylphenol, or 4-dodecyl-2,6-di-tert-butylphenol. In one embodiment the hindered phenol antioxidant may be an ester and may include, e.g., Irganox™ L-135 from Ciba. A more detailed description of suitable ester-containing hindered phenol antioxidant chemistry is found in U.S. Pat. No. 6,559,105.

In one embodiment the invention provides a lubricating composition further comprising at least one of a dispersant, an antiwear agent, a dispersant viscosity modifier, a friction modifier, a viscosity modifier, an antioxidant, an overbased detergent, an extreme pressure agent, or mixtures thereof. In one embodiment the invention provides a lubricating composition further comprising at least one of a polyisobutylene succinimide dispersant, an antiwear agent, a dispersant viscosity modifier, a friction modifier, a viscosity modifier (typically an olefin copolymer such as an ethylene-propylene copolymer), an antioxidant (including phenolic and aminic antioxidants), an overbased detergent (including overbased sulphonates and phenates), an extreme pressure agent, or mixtures thereof.

In one embodiment the invention provides a lubricating composition comprising the star polymer of the present invention, an overbased detergent, a dispersant, an antiwear agent (such as a metal dialkyldithiophosphate, in particular a zinc dialkyldithiophosphate, an amine phosphate, or a phosphite), and an oil of lubricating viscosity. Typically a lubricating composition of this type may be useful for an internal combustion engine or a manual transmission.

In one embodiment the invention provides a lubricating composition comprising the star polymer of the present invention, an antiwear agent, a corrosion inhibitor, and an oil of lubricating viscosity. Typically a lubricating composition of this type may be useful for a hydraulic device.

In one embodiment the invention provides a lubricating composition comprising the star polymer of the present invention, a phosphorus-containing acid, salt, or ester, an extreme pressure agent, other than a phosphorus-containing acid, salt, or ester, and an oil of lubricating viscosity. Optionally the lubricating composition may also include a friction modifier, a detergent or a dispersant. Typically a lubricating composition of this type may be useful for an automatic transmission, a manual transmission, a gear or an axle.

In one embodiment the invention provides a lubricating composition comprising the star polymer of the present invention, a phosphorus-containing acid, salt, or ester, a dispersant, and an oil of lubricating viscosity. Optionally the lubricating composition may also include a friction modifier, a detergent or an inorganic phosphorus compound (such as phosphoric acid). Typically a lubricating composition of this type may be useful for an automatic transmission.

The overbased detergent includes phenates (including alkyl phenates and sulphur containing phenates), sulphonates, salixarates, carboxylates (such as salicylates), overbased phosphorus acids; alkyl phenols, overbased sulphur coupled alkyl phenol compounds, or saligenin detergents. In one embodiment the overbased detergent comprises one or more of salixarates, phenates, sulphonates, or salicylates. In one embodiment the overbased detergent may be a salicylate. In one embodiment the overbased detergent may be a sulphonate. In one embodiment the overbased detergent may be a phenate. In one embodiment the overbased detergent may be a salixarate.

In one embodiment the overbased detergent comprises mixtures of at least two substrates. When two or more detergent substrates are used, the overbased detergent formed may be described as a complex/hybrid. Typically the complex/hybrid may be prepared by reacting in the presence of the suspension and acidifying overbasing agent, alkyl aromatic sulphonic acid, at least one alkyl phenol (such as, alkyl phenol, aldehyde-coupled alkyl phenol, sulphurised alkyl phenol) and optionally alkyl salicylic acid. A more detailed description of hybrid detergents is disclosed in WO97046643.

When the overbased detergent comprises at least one of a phenate, salixarate or salicylate detergent, the TBN on an oil-free basis may be 105 to 450, or from 110 to 400, or from 120 to 350. When the overbased detergent comprises an overbased sulphonate, the TBN may be 200 or more to 500, or 350 to 450. The overbased detergent is typically salted with an alkali or alkaline earth metal. The alkali metal includes lithium, potassium or sodium; and the alkaline earth metal includes calcium or magnesium. In one embodiment the alkali metal is sodium. In one embodiment the alkaline earth metal is calcium. In one embodiment the alkaline earth metal is magnesium.

The detergent may be present at 0.1 wt % to 10 wt %, or 0.1 wt % to 8 wt %, or 1 wt % to 4 wt %, or greater than 4 to 8 wt %.

The dispersant may be a succinimide dispersant (for example N-substituted long chain alkenyl succinimides), a Mannich dispersant, an ester-containing dispersant, a condensation product of a long chain hydrocarbyl (such as a fatty hydrocarbyl or polyisobutylene) monocarboxylic acylating agent with an amine or ammonia, an alkyl amino phenol dispersant, a hydrocarbyl-amine dispersant, a polyether dispersant, or a polyetheramine dispersant.

The succinimide dispersant may be derived from an aliphatic polyamine, or mixtures thereof. The aliphatic polyamine may be aliphatic polyamine such as an ethylenepolyamine, a propylenepolyamine, a butylenepolyamine, or mixtures thereof. In one embodiment the aliphatic polyamine may be ethylenepolyamine. In one embodiment the aliphatic polyamine may be selected from the group consisting of ethylenediamine, diethylenetriamine, triethylenetetramine, tetraethylenepentamine, pentaethylene-hexamine, polyamine still bottoms, and mixtures thereof.

The dispersant may be an N-substituted long chain alkenyl succinimide. Examples of N-substituted long chain alkenyl succinimide include polyisobutylene succinimide. Typically the polyisobutylene from which polyisobutylene succinic anhydride is derived has a number average molecular weight of 350 to 5000, or 550 to 3000 or 750 to 2500. The long chain alkenyl succinimide may include polyisobutylene succinimide, wherein the polyisobutylene from which it is derived has a number average molecular weight in the range 350 to 5000, or 500 to 3000, or 750 to 1150. Succinimide dispersants and their preparation are disclosed, for instance in U.S. Pat. Nos. 3,172,892, 3,219,666, 3,316,177, 3,340,281, 3,351,552, 3,381,022, 3,433,744, 3,444,170, 3,467,668, 3,501,405, 3,542,680, 3,576,743, 3,632,511, 4,234,435, Re 26,433, and 6,165,235, 7,238,650 and EP Patent Application 0 355 895 A.

In one embodiment the dispersant for a driveline device may be a post treated dispersant. The dispersant may be post treated with dimercaptothiadiazole, optionally in the presence of one or more of a phosphorus compound, a dicarboxylic acid of an aromatic compound, and a borating agent.

In one embodiment the post treated dispersant may be formed by heating an alkenyl succinimide or succinimide detergent with a phosphorus ester and water to partially hydrolyze the ester. The post treated dispersant of this type is disclosed for example in U.S. Pat. No. 5,164,103.

In one embodiment the post treated dispersant may be produced by preparing a mixture of a dispersant and a dimercaptothiadiazole and heating the mixture above about 100° C. The post treated dispersant of this type is disclosed for example in U.S. Pat. No. 4,136,043.

In one embodiment the dispersant may be post treated to form a product prepared comprising heating together: (i) a dispersant (typically a succinimide), (ii) 2,5-dimercapto-1,3,4-thiadiazole or a hydrocarbyl-substituted 2,5-dimercapto-1,3,4-thiadiazole, or oligomers thereof, (iii) a borating agent (similar to those described above); and (iv) optionally a dicarboxylic acid of an aromatic compound selected from the group consisting of 1,3 diacids and 1,4 diacids (typically terephthalic acid), or (v) optionally a phosphorus acid compound (including either phosphoric acid or phosphorous acid), said heating being sufficient to provide a product of (i), (ii), (iii) and optionally (iv) or optionally (v), which is soluble in an oil of lubricating viscosity. The post treated dispersant of this type is disclosed for example in International Application WO 2006/654726 A.

Examples of a suitable dimercaptothiadiazole include 2,5-dimercapto-1,3,4-thiadiazole or a hydrocarbyl-substituted 2,5-dimercapto-1,3,4-thiadiazole. In several embodiments the number of carbon atoms on the hydrocarbyl-substituent group includes 1 to 30, 2 to 25, 4 to 20, or 6 to 16. Examples of suitable 2,5-bis(alkyl-dithio)-1,3,4-thiadiazoles include 2,5-bis(tert-octyldithio)-1,3,4-thiadiazole 2,5-bis(tert-nonyldithio)-1,3,4-thia-diazole, 2,5-bis(tert-decyldithio)-1,3,4-thiadiazole, 2,5-bis(tert-undecyl-dithio)-1,3,4-thia-diazole, 2,5-bis(tert-dodecyldithio)-1,3,4-thiadiazole, 2,5-bis(tert-tridecyldithio)-1,3,4-thiadiazole, 2,5-bis(tert-tetradecyldithio)-1,3,4-thia-diazole, 2,5-bis(tert-pentadecyldithio)-1,3,4-thiadiazole, 2,5-bis(tert-hexadecyl-dithio)-1,3,4-thiadiazole, 2,5-bis(tert-heptadecyldithio)-1,3,4-thiadiazole, 2,5-bis(tert-octadecyl-dithio)-1,3,4-thiadiazole, 2,5-bis(tert-nonadecyldithio)-1,3,4-thiadiazole or 2,5-bis(tert-eicosyldithio)-1,3,4-thiadiazole, or oligomers thereof.

The dispersant may be present at 0.01 wt % to 20 wt %, or 0.1 wt % to 15 wt %, or 0.1 wt % to 10 wt %, or 1 wt % to 6 wt % of the lubricating composition.

The antiwear agent includes (i) a non-ionic phosphorus compound; (ii) an amine salt of a phosphorus compound; (iii) an ammonium salt of a phosphorus compound; (iv) a monovalent metal salt of a phosphorus compound, such as a metal dialkyldithiophosphate or a metal dialkylphosphate; or (v) mixtures of (i), (ii), (iii) or (iv).

Examples of a suitable zinc dialkylphosphate (often referred to as ZDDP, ZDP or ZDTP) include zinc di-(2-methylpropyl)dithiophosphate, zinc di-(amyl)dithiophosphate, zinc di-(1,3-dimethylbutyl)dithiophosphate, zinc di-(heptyl)dithiophosphate, zinc di-(octyl)dithiophosphate di-(2-ethylhexyl)dithiophosphate, zinc di-(nonyl) dithiophosphate, zinc di-(decyl)dithiophosphate, zinc di-(dodecyl)dithiophosphate, zinc di-(dodecylphenyl) dithiophosphate, zinc di-(heptylphenyl)dithiophosphate, or mixtures thereof.

The amine salt of a phosphorus acid or ester includes phosphoric acid esters and amine salts thereof; dialkyldithiophosphoric acid esters and amine salts thereof; amine salts of phosphites; and amine salts of phosphorus-containing carboxylic esters, ethers, and amides; and mixtures thereof.

In one embodiment the amine salt of a phosphorus compound is derived from an amine salt of a phosphorus compound, or mixtures thereof. In one embodiment the amine salt of a phosphorus acid or ester includes a partial amine salt-partial metal salt compounds or mixtures thereof. In one embodiment the amine salt of a phosphorus acid or ester further comprises a sulphur atom in the molecule.

The amines which may be suitable for use as the amine salt include primary amines, secondary amines, tertiary amines, and mixtures thereof. The amines include those with at least one hydrocarbyl group, or, in certain embodiments, two or three hydrocarbyl groups. The hydrocarbyl groups may contain about 2 to about 30 carbon atoms, or in other embodiments about 8 to about 26, or about 10 to about 20, or about 13 to about 19 carbon atoms.

Primary amines include ethylamine, propylamine, butylamine, 2-ethylhexylamine, octylamine, and dodecylamine, as well as such fatty amines as n-octylamine, n-decylamine, n-dodecylamine, n-tetradecylamine, n-hexadecylamine, n-octadecylamine, and oleyamine. Other useful fatty amines include commercially available fatty amines such as "Armeen®" amines (products available from Akzo Chemicals, Chicago, Ill.), such as Armeen C, Armeen O, Armeen OL, Armeen T, Armeen HT, Armeen S and Armeen SD, wherein the letter designation relates to the fatty group, such as coco, oleyl, tallow, or stearyl groups.

Examples of suitable secondary amines include dimethylamine, diethylamine, dipropylamine, dibutylamine, diamylamine, dihexylamine, diheptylamine, methylethylamine, ethylbutylamine, and ethylamylamine. The secondary amines may be cyclic amines such as piperidine, piperazine, and morpholine.

The amine may also be a tertiary-aliphatic primary amine. The aliphatic group in this case may be an alkyl group containing about 2 to about 30, or about 6 to about 26, or about 8 to about 24 carbon atoms. Tertiary alkyl amines include monoamines such as tert-butylamine, tert-hexylamine, 1-methyl-1-amino-cyclohexane, tert-octylamine, tert-decylamine, tert-dodecylamine, tert-tetradecylamine, tert-hexadecylamine, tert-octadecylamine, tert-tetracosanylamine, and tert-octacosanylamine.

In one embodiment the amine salt of a phosphorus acid or ester includes an amine with C11 to C14 tertiary alkyl primary groups or mixtures thereof. In one embodiment the amine salt of a phosphorus compound includes an amine with C14 to C18 tertiary alkyl primary amines or mixtures thereof.

In one embodiment the amine salt of a phosphorus compound includes an amine with C18 to C22 tertiary alkyl primary amines or mixtures thereof.

Mixtures of amines may also be used in the invention. In one embodiment a useful mixture of amines is "Primene® 81R" and "Primene® JMT." Primene® 81R and Primene® JMT (both produced and sold by Rohm & Haas) are mixtures of C11 to C14 tertiary alkyl primary amines and C18 to C22 tertiary alkyl primary amines respectively.

In one embodiment the amine salt of a phosphorus acid or ester is the reaction product of a C14 to C18 alkylated phosphoric acid with Primene 81R™ (produced and sold by Rohm & Haas) which is a mixture of C11 to C14 tertiary alkyl primary amines.

In one embodiment a dithiophosphoric acid or phosphoric acid may be reacted with an epoxide or a glycol. This reaction product is further reacted with a phosphorus acid, anhydride, or lower ester (where "lower" signifies about 1 to about 8, or about 1 to about 6, or about 1 to about 4, or 1 to about 2 carbon atoms in the alcohol-derived portion of the ester). The epoxide includes an aliphatic epoxide or a styrene oxide. Examples of useful epoxides include ethylene oxide, propylene oxide, butene oxide, octene oxide, dodecene oxide, styrene oxide and the like. In one embodiment the epoxide is propylene oxide. The glycols may be aliphatic glycols having 1 to about 12, or about 2 to about 6, or about 2 to about 3 carbon atoms. The dithiophosphoric acids, glycols, epoxides, inorganic phosphorus reagents and methods of reacting the same are described in U.S. Pat. Nos. 3,197,405 and 3,544,465. The resulting acids may then be salted with amines. An example of suitable dithiophosphoric acid derivative is prepared by adding phosphorus pentoxide (about 64 grams) at about 58° C. over a period of about 45 minutes to about 514 grams of hydroxypropyl O,O-di(4-methyl-2-pentyl)phosphorodithioate (prepared by reacting di(4-methyl-2-pentyl)-phosphorodithioic acid with about 1.3 moles of propylene oxide at about 25° C.). The mixture is heated at about 75° C. for about 2.5 hours, mixed with a diatomaceous earth and filtered at about 70° C. The filtrate contains about 11.8% by weight phosphorus, about 15.2% by weight sulphur, and an acid number of 87 (bromophenol blue).

In one embodiment the phosphorus-containing acid, salt or ester comprises a non-ionic phosphorus compound. Typically the non-ionic phosphorus compound may have an oxidation state of +3 or +5. The different embodiments comprise phosphite ester, phosphate esters, or mixtures thereof. A more detailed description of the non-ionic phosphorus compound include column 9, line 48 to column 11, line 8 of U.S. Pat. No. 6,103,673.

The phosphorus-containing acid, salt or ester may be present in the lubricating composition at about 0.01 wt % to about 20 wt %, or about 0.05 wt % to about 10 wt %, or about 0.1 wt % to about 5 wt % of the lubricating composition.

When the extreme pressure agent is other than a phosphorus-containing acid, salt, or ester, the extreme pressure agent may include a boron-containing compound, a sulphur-containing compound, or mixtures thereof. The extreme pressure agent may be present in the lubricating composition at about 0.01 wt % to about 20 wt %, or about 0.05 wt % to about 10 wt %, or about 0.1 wt % to about 8 wt % of the lubricating composition.

In one embodiment the extreme pressure agent is a sulphur-containing compound. In one embodiment the sulphur-containing compound is a sulphurised olefin, a polysulphide, or mixtures thereof. Examples of the sulphurised olefin include an olefin derived from propylene, isobutylene, pentene, an organic sulphide and/or polysulphide including benzyldisulphide; bis-(chlorobenzyl)disulphide; dibutyl tetrasulphide; di-tertiary butyl polysulphide; and sulphurised methyl ester of oleic acid, a sulphurised alkylphenol, a sulphurised dipentene, a sulphurised terpene, a sulphurised Diels-Alder adduct, an alkyl sulphenyl N'N-dialkyl dithiocarbamates; or mixtures thereof. In one embodiment the sulphurised olefin includes a sulphurised olefin derived from propylene, isobutylene, pentene or mixtures thereof.

In one embodiment the extreme pressure agent comprises a boron-containing compound. The boron-containing compound includes a borate ester, a borate alcohol, a borated dispersant or mixtures thereof. In one embodiment the boron-containing compound is a borate ester or a borate alcohol. The borate ester or borate alcohol compounds are substantially the same except the borate alcohol has at least one hydroxyl group that is not esterified. Therefore, as used herein the term "borate ester" is used to refer to either borate ester or borate alcohol.

The borate ester may be prepared by the reaction of a boron compound and at least one compound selected from epoxy compounds, halohydrin compounds, epihalohydrin compounds, alcohols and mixtures thereof. The alcohols include dihydric alcohols, trihydric alcohols or higher alcohols, with the proviso for one embodiment that hydroxyl groups are on adjacent carbon atoms i.e. vicinal. Hereinafter "epoxy compounds" is used when referring to "at least one compound selected from epoxy compounds, halohydrin compounds, epihalohydrin compounds and mixtures thereof."

Boron compounds suitable for preparing the borate ester include the various forms selected from the group consisting of boric acid (including metaboric acid, $HBO_2$, orthoboric acid, $H_3BO_3$, and tetraboric acid, $H_2B_4O_7$), boric oxide, boron trioxide and alkyl borates. The borate ester may also be prepared from boron halides.

In another embodiment, the boron-containing compound is a borated dispersant, typically derived from an N-substituted long chain alkenyl succinimide. In one embodiment the borated dispersant comprises a polyisobutylene succinimide. The polyisobutylene succinimide may be the same as described above, except it has been borated, typically with boric acid.

Examples of a corrosion inhibitor comprises at least one of benzotriazoles, 1,2,4-triazoles, benzimidazoles, 2-alkyldithiobenzimidazoles, 2-alkyldithiobenzothiazoles, 2-(N,N-dialkyldithiocarbamoyl)benzothiazoles, 2,5-bis(alkyldithio)-1,3,4-thiadiazoles, 2,5-bis(N,N-dialkyldithiocarbamoyl)-1,3,4-thiadiazoles, 2-alkyldithio-5-mercapto thiadiazoles or mixtures thereof. In one embodiment the corrosion inhibitor is benzotriazole. In one embodiment the corrosion inhibitor is a 2,5-bis(alkyl-dithio)-1,3,4-thiadiazole. The corrosion inhibitor may be used alone or in combination with other corrosion inhibitors.

The corrosion inhibitor may be a condensation product of dodecenyl succinic acid or anhydride and a fatty acid such as oleic acid with a polyamine. In one embodiment the corrosion inhibitors include the Synalox® corrosion inhibitor. The Synalox® corrosion inhibitor is typically a homopolymer or copolymer of propylene oxide. The Synalox® corrosion inhibitor is described in more detail in a product brochure with Form No. 118-01453-0702 AMS, published by The Dow Chemical Company. The product brochure is entitled "SYNALOX Lubricants, High-Performance Polyglycols for Demanding Applications."

In one embodiment the lubricating composition further includes a friction modifier, or mixtures thereof.

The friction modifier may be an amine-containing friction modifier including those derivable from a primary, secondary or tertiary amine. Typically the amine is hydrocarbyl- or hydroxyhydrocarbyl-substituted.

The amine-containing friction modifier may be a hydrocarbyl-substituted primary amine, a hydroxyhydrocarbyl-substituted amine, or mixtures thereof (or, in each instance, alkyl- or hydroxyalkyl-substituted amine). In one embodiment amine-containing friction modifier is a hydroxyhydrocarbyl-substituted amine, typically a tertiary amine.

When the amine-containing friction modifier is the hydroxyhydrocarbyl-substituted amine and is a tertiary amine, the amine typically contains two hydroxyhydrocarbyl groups and one hydrocarbyl group bonded directly to the nitrogen of the amine. The hydrocarbyl group may contain 1 to 30, or 4 to 26, or 12 to 20 carbon atoms. In one embodiment the hydrocarbyl group contains 16 to 18 carbon atoms.

In one embodiment the friction modifier may be a hydroxyhydrocarbyl-substituted (e.g., hydroxyalkyl-substituted) amine. The hydroxyhydrocarbyl-substituted amine may be derived from an alkoxy-group containing 1 to 10, 1 to 6 or 2 to 4 carbon atoms. Examples of a suitable alkoxylated amine (as such materials are often called) include ethoxylated amines. Ethoxylated amines may be derived from 1.79% Ethomeen® T-12 and 0.90% Tomah PA-1 as described in Example E of U.S. Pat. No. 5,703,023, column 28, lines 30 to 46. Other suitable alkoxylated amine compounds include commercial alkoxylated fatty amines known by the trademark "ETHOMEEN" and available from Akzo Nobel. Representative examples of these ETHOMEEN™ materials is ETHOMEEN™ C/12 (bis[2-hydroxyethyl]-coco-amine); ETHOMEEN™ C/20 (polyoxyethylene [10]cocoamine); ETHOMEEN™ S/12 (bis[2-hydroxyethyl]soyamine); ETHOMEEN™ T/12 (bis[2-hydroxyethyl]allow-amine); ETHOMEEN™ T/15 (polyoxyethylene-[5]tallowamine); ETHOMEEN™ D/12 (bis[2-hydroxyethyl]oleyl-amine); ETHOMEEN™ 18/12 (bis[2-hydroxyethyl]octadecylamine); and ETHOMEEN™ 18/25 (polyoxyethylene[15] octadecylamine). Suitable fatty amines and ethoxylated fatty amines are also described in U.S. Pat. No. 4,741,848.

When the hydrocarbyl-substituted amine is a primary amine, the hydrocarbyl group may contain 1 to 30, or 4 to 26, or 12 to 20 carbon atoms. In one embodiment the hydrocarbyl group contains 14 to 18 carbon atoms.

Primary amines include ethylamine, propylamine, butylamine, 2-ethylhexylamine, octylamine, and dodecylamine, as well as such fatty amines as n-octylamine, n-decylamine, n-dodecylamine, n-tetradecylamine, n-hexadecylamine, n-octadecylamine, and oleyamine. Other useful fatty amines include commercially available fatty amines such as "Armeen®" amines (products available from Akzo Chemicals, Chicago, Ill.), such as Armeen C, Armeen O, Armeen OL, Armeen T, Armeen HT, Armeen S and Armeen SD, wherein the letter designation relates to the fatty group, such as coco, oleyl, tallow, or stearyl groups.

The friction modifier may be present at 0.01 wt % to 5 wt %, 0.02 wt % to 2 wt %, or 0.05 wt % to 1 wt % of the lubricating composition.

A more detailed description of other performance additives listed above may be found in International publication WO 2007/127615 A (describes driveline additives, particularly for automatic or manual transmissions), in International publication WO 2007/127660 A (describes driveline additives, particularly for gear oils or axle oils), in International publication WO 2007/127663 A (describes additives for hydraulic fluids), and in International publication WO 2007/127661 A (describes additives, for internal combustion lubricants).

INDUSTRIAL APPLICATION

The star polymer of the invention may be useful for a lubricant suitable for lubricating a variety of mechanical devices. The mechanical device includes at least one of an internal combustion engine (for crankcase lubrication), a hydraulic system, or a driveline system.

In one embodiment the internal combustion engine may be a diesel fuelled engine (typically a heavy duty diesel engine), a gasoline fuelled engine, a natural gas fuelled engine or a mixed gasoline/alcohol fuelled engine. In one embodiment the internal combustion engine may be a diesel fuelled engine and in another embodiment a gasoline fuelled engine. In one embodiment the internal combustion engine may be a heavy duty diesel engine.

The internal combustion engine may or may not have an Exhaust Gas Recirculation (EGR) system. The internal combustion engine may be fitted with an emission control system or a turbocharger. Examples of the emission control system include diesel particulate filters (DPF), or systems employing selective catalytic reduction (SCR).

The internal combustion engine may be a 2-stroke or 4-stroke engine. Suitable internal combustion engines include marine diesel engines, aviation piston engines, low-load diesel engines, and automobile and truck engines.

Typically the driveline system utilises a driveline lubricant selected from an axle oil, a gear oil, a gearbox oil, a traction drive transmission fluid, an automatic transmission fluid or a manual transmission fluid.

The gear oil or axle oil may be used in planetary hub reduction axles, mechanical steering and transfer gear boxes in utility vehicles, synchromesh gear boxes, power take-off gears, limited slip axles, and planetary hub reduction gear boxes.

The automatic transmission includes continuously variable transmissions (CVT), infinitely variable transmissions (IVT), Toroidal transmissions, continuously slipping torque converted clutches (CSTCC), stepped automatic transmissions or dual clutch transmissions (DCT).

Typically, the hydraulic system utilises a hydraulic fluid (which may be a piston pump fluid or a vane pump fluid), and an internal combustion engine utilizes an engine lubricant.

The star polymer of the present invention may be present in a lubricant for a gear oil or axle fluid at 2 to 60 wt %, or 5 to 50 wt %, or 10 to 40 wt % of the lubricant. The weight average molecular weight of the star polymer for a gear or axle lubricant may be in the range of 8,000 to 150,000, or 10,000 to 100,000 or 15,000 to 75,000, or 25,000 to 70,000.

The star polymer of the present invention may be present in a lubricant for an automatic transmission fluid at 0.5 wt % to 12 wt %, or 1 wt % to 10 wt %, or 2 wt % to 8 wt % of the lubricant. The weight average molecular weight of the star polymer in an automatic transmission lubricant may be in the range of 125,000 to 400,000, or 175,000 to 375,000 or 225,000 to 325,000.

The star polymer of the present invention may be present in a lubricant for hydraulic fluid at 0.01 wt % to 12 wt %, or 0.05 wt % to 10 wt %, or 0.075 wt % to 8 wt % of the lubricant. The weight average molecular weight of the star polymer of the invention for hydraulic fluid may be in the range of 50,000 to 1,000,000, or 100,000 to 800,000, or 120,000 to 700,000.

The star polymer of the present invention may be present in a lubricant for an internal combustion engine at 0.01 to 12 wt %, or 0.05 wt % to 10 wt %, or 0.075 to 8 wt % of the lubricant. The weight average molecular weight of the star polymer of the invention in an internal combustion engine may be 100,000 to 1,000,000, or 200,000 to 1,000,000, or 300,000 to 1,000,000, or 350,000 to 1,000,000, or 400,000 to 800,000.

Phosphorus compounds are often the primary antiwear agent in a lubricant, typically a zinc dialkyldithiophosphate (ZDDP) in engine oil and hydraulic fluids, an ashless ester like dibutyl phosphite in automatic transmission fluids and an amine salt of an alkylphosphoric acid in gear oils. In engine oils the amount of phosphorus (typically supplied as ZDDP) may be less than 0.08% by weight P in the finished lubricant, or 0.02-0.06% by weight P. In hydraulic fluids, automatic transmission fluids and gear oils, the phosphorus level may be even lower, such as 0.05 or less, or 0.01-0.04 or 0.01-0.03% by weight P.

The following examples provide illustrations of the invention. These examples are non exhaustive and are not intended to limit the scope of the invention.

EXAMPLES

Preparative Example 1 (EX1): is a block arm star polymer of C12-15-alkyl methacrylate (LMACR) and methyl methacrylate (MMACR). One block of the arm contains 90 wt % LMACR and 10 wt % MMACR, and a second block contains 70% LMACR and 30% MMACR. The mass of the monomers for the two blocks is approximately equal. The polymer is prepared by charging the reactants into a 500 mL flask equipped with nitrogen inlet, stirrer, thermocouple and a condenser. The reagents include 81 g of LMACR, 9 g of MMACR, 1.22 g of Trigonox®21 initiator, 7.09 g of a chain transfer agent (2-dodecylsulphanylthiocarbonylsulphanyl-2-methyl-propionic acid butyl ester), and 86.44 g of an API Group III 80 N paraffin diluent oil. The flask is stirred and purged with nitrogen at 0.014 $m^3$/hours (0.5 SCFH). The flask is heated to 75° C. and held at 75° C. for 2 hours. A mixture of 27 g of MMACR and 63 g LMACR is then added and the reaction is held at 75° C. for two hours. The temperature is raised to 90° C., and when the temperature reaches 85° C., 13.18 g of ethylene glycol dimethacrylate (EGDMA) is added. The flask is held for 3 hours at 90° C. The product is a viscous liquid.

The other preparative examples (EX2, EX3, EX4, EX5 and EX6) are block arm stars made in a manner similar to that of EX1. Some adjustments of the reactants are made to produce examples with different monomer ratios and molecular weights.

Table 1 summarizes the composition and architectures of EX1 to EX6.

Comparative Example 1 (CE1) is a random star polymer similar to Example 38 of WO2006047393. The polymer is prepared by charging agents into a 250 mL flask equipped with nitrogen inlet, stirrer, thermocouple and a water cooled condenser. The reagents include 80 g of LMACR, 20 g of MMACR, 0.69 g of Trigonox®21 initiator, 4.02 g of a chain transfer agent (2-dodecylsulphanylthiocarbonylsulphanyl-2-methyl-propionic acid butyl ester), and 74.7 g of an API Group III 80 N paraffin diluent oil. The flask is stirred and purged with nitrogen at 0.028 $m^3$/hours (1 SCFH) for 30 minutes. The nitrogen flow rate is the reduced to 0.014 $m^3$/hours (0.5 SCFH) and the flask is heated to 75° C. and held at this temperature for 4 hours. 7.43 g of ethylene glycol dimethacrylate (EGDMA) is added. The temperature is then raised to 90° C. The reaction is held at this temperature for 3 hours. The product is a viscous liquid.

Other comparative examples (CE2, CE3, CE4 and CE5) are random arm stars made similarly to CE1 but with different monomer compositions and molecular weight. Table 2 summarizes the compositions of CE1, to CE5.

TABLE 2

Composition of Random Arm Stars CE1 to CE5

| Example | Monomer Composition (wt %) |
|---|---|
| CE1 | 80% LMACR + 20% MMACR |
| CE2 | 79.5% LMACR + 0.5% EHMA + 20% MMACR |
| CE3 | 70% LMACR + 30% MMACR |
| CE4 | 80% LMACR + 10% EHMA + 10% MMACR |
| CE5 | 79.6% LMACR + 0.5% EHMA + 19.9% MMACR |

Comparative Example 6 (CE6) is a block star polymer similar to example 42 of WO2006047393.80 g of LMACR, 0.69 g of Trigonox®21 initiator, 4.02 g of a chain transfer agent (2-dodecylsulphanylthiocarbonylsulphanyl-2-methyl-propionic acid butyl ester), and 74.7 g of an API Group III 80 N paraffin diluent oil are added to a round bottom flask equipped with a nitrogen inlet, stirrer, thermocouple and a water cooled condenser. The flask is stirred and purged with nitrogen at 0.014 $m^3$/hours (0.5 SCFH). The flask is heated to 75° C. and held at this temperature for 2 hours upon which

TABLE 1

List of Preparation Samples.

| | Monomer Composition (wt %) | | | | Weight Ratio | | |
|---|---|---|---|---|---|---|---|
| Example | Outer Block (wt %) | $C_n^o$ | Inner Block (wt %) | $C_n^i$ | of Outer Block to Inner Block | Polymer Composition (wt %) | $C_n^o - C_n^i$ |
| EX1 | 90% LMACR ++ 10% MMACR | 10.37 | 70% LMACR + 30% MMACR | 6.64 | 50:50 | 80% LMACR + 20% MMACR | 3.73 |
| EX2 | 86.1% LMACR + 2.0% EHMA + 11.8% MMACR | 9.85 | 76.7% LMACR + 23.3% MMACR | 7.69 | 27.6:72.4 | 79.3% LMACR + 0.6% EHMA + 20.1% MMACR | 2.16 |
| EX3 | 90% LMACR + 10% MMACR | 10.37 | 63.3% LMACR + 37.7% MMACR | 5.68 | 25:75 | 70% LMACR + 30% MMACR | 4.69 |
| EX4 | 80% LMACR + 20% MMACR | 8.27 | 66.7% LMACR + 33.3% MMACR | 6.18 | 25:75 | 70% LMACR + 30% MMACR | 2.08 |
| EX5 | 80% LMACR + 20% EHMA | 11.87 | 73.3% LMACR + 26.7% MMACR | 7.14 | 25:75 | 75% LMACR + 5% EHMA + 20% MMACR | 4.73 |
| EX6 | 80% LMACR + 10% EHMA + 10% MMACR | 9.87 | 70% LMACR + 30% MMACR | 6.64 | 50:50 | 75% LMACR + 5% EHMA + 20% MMACR | 3.22 |

Footnote:
EHMA = 2-ethylhexyl (meth)acrylate
$C_n^o$: number average carbon number in the alkyl group of outer block
$C_n^i$: number average carbon number in the alkyl group of inner block time 20 g of methyl methacrylate (MMACR) is added. The reaction is held for 2 hours at 75° C. The reaction is heated to 90° C. and 7.43 g of ethylene glycol dimethacrylate (EGDMA) is added. The reaction is held at this temperature for 3 hours. The product is a viscous liquid.

Comparative Example 7 (CE7) is a block star polymer similar to example 43 of WO2006047393. Some adjustments of the reactants are made to produce an example with different monomer ratios and molecular weight. Table 3 summarizes the compositions and architectures of CE6 and CE7.

TABLE 3

Composition of Comparative Samples CE6 and CE7.

| Example | Monomer Composition: Outer block (wt %) | Monomer Composition: Inner block (wt %) | wt % ratio of outer block to inner block | Polymer Composition |
|---|---|---|---|---|
| CE6 | 100% LMACR | 100% MMACR | 80:20 | 80% LMACR + 20% MMACR |
| CE7 | 100% LMACR | 100% MMACR | 70:30 | 70% LMACR + 30% MMACR |

Storage Stability

Lubricant example LC1 is an ATF fluid comprising EX1. The ATF fluid also contains 2.5 wt % (including 43 wt % diluent oil) of a polyisobutylene succinimide wherein the polyisobutylene group is derived from a polyisobutylene with a number average molecular weight of 950, 0.5 wt % (including 42 wt % diluent oil) polyisobutenylsuccinimide that has been post-treated with carbon disulphide, 0.2 wt % of dibutyl phenol, 0.42 wt % of a nonylated diphenyl amine, 0.02 wt % of Ethomeen® T-12, 0.04 wt % of an alkenyl imidazoline friction modifier. Comparative Lubricant examples CLC1 is similar to LC1 except it uses CE1 in the place of EX1. The ATF fluids further comprise a base oil and an additive package. The Kinematic Viscosity (KV, units cSt) and Brookfield Viscosity (BV, units cP) are determined employing ASTM methods D445 at 100° C. and 40° C. and D2983 at −40° C. respectively. The viscosity index (VI) is also determined by employing the ASTM method D2270. The lubricating composition is also subjected to shear as ASTM D5621. The viscosity (100° C.) losses after the sonic shear are calculated to indicate the shear stability of the polymer. The data obtained is:

| | Polymer | D445 (at 100° C.) | D445 (at 40° C.) | VI | D2983 (at −40° C.) | Viscosity loss (after D5621) |
|---|---|---|---|---|---|---|
| LC1 | EX1 | 6.48 | 26.4 | 215 | 7080 | −12.4% |
| CLC1 | CE1 | 6.42 | 26.0 | 217 | 6350 | −10.4% |

The data obtained indicates that these properties of LC1 and CLC1 are approximately comparable.

Example EX7 is a concentrate blend of EX1 and the ATF additive package used in the ATF fluid mentioned above. The ratio of the EX1 and the ATF additive package is determined by LC1 so that after blending EX7 with the base oil the same viscometric character of LC1 will be obtained. Comparative example CE8 is made similarly according to CLC1. The storage stability is assessed by observing the clarity of the EX7 and CE8 at room temperature with a steel coupon in the concentrates. The results obtained indicate that inventive example EX7 remains clear after 4 weeks. In contrast, CE8 containing the random arm star polymer shows phase separation. This indicates that the comparative example is less stable than the present invention.

Additive Package Compatibility

Star polymers 10 wt % of EX2 and CE2 are blended with a 6 ($mm^2/s$ (or cSt) polyalphaolefin (PAO-6) base oil at 80° C. until homogeneous. Both blends are stored at room temperature for seven days. The polyalphaolefin containing the star polymer of the invention (EX2) is clear at the end of the test. In contrast, the polyalphaolefin containing the random-block star polymer (CE2) shows gelling. This indicates that the star polymer of the present invention is more soluble in an oil of lubricating viscosity compared to a comparative random-block star polymer.

Viscometrics

Lubricant examples LC2 and LC3 are similar ATF fluids as LC1 but comprising EX3 and EX4, respectively. Comparative Lubricant examples CLC2, CLC3 and CLC4 are also similar ATF fluids but comprising CE2, CE6 and CE7 respectively. The Kinematic Viscosity (KV, units $mm^2/s$ or cSt) and Brookfield Viscosity (BV, units cP) are determined employing ASTM methods D445 at 100° C. and 40 C and D2983 at −40° C. respectively. The viscosity index (VI) is also determined by employing the ASTM method D2270. The lubricating composition is also subjected to shear as ASTM D5621. The viscosity (100° C.) losses after the sonic shear are calculated to indicate the shear stability of the polymer. The data obtained is:

| | Polymer | Treat Rate (wt %) | D445 (at 100° C.) | D445 (at 40° C.) | V.I. | D2983 (at −40° C.) | Viscosity loss (after D5621) |
|---|---|---|---|---|---|---|---|
| LC2 | EX3 | 8.39 | 6.62 | 26.44 | 223 | 7280 | −6.3% |
| LC3 | EX4 | 8.39 | 6.81 | 27.01 | 229 | 7650 | −5.1% |
| CLC2 | CE3 | 7.17 | 6.6 | 26.23 | 225 | 38000 | −9.3% |
| CLC3 | CE6 | 8.19 | 6.52 | 27.29 | 208 | 880000 | −10.2% |
| CLC4 | CE7 | 8.8 | 6.73 | 28.0 | 213 | >1M | −7.3% |

The results indicate that the ATF fluids (LC2 and LC3) that contain the innovative examples EX3 and EX4 have lower viscosity at −40° C. than that of the ATF fluids (CLC2, and CLC4) containing comparative samples (CE3, and CE7). LC2 and LC3 also show higher VI and lower viscosity at −40° C. than the comparative examples (CLC3 and CLC4), which are block arm stars taught in WO2006047393.

Two manual transmission fluids (LC4 and LC5) are prepared with EX5 and EX6, respectively. Comparative lubricant example (CLC5 and CLC6) are prepared with CE4 and CE5, respectively. The amount of polymer added is sufficient to provide approximately equal kinematic viscosity at 100° C. The Kinematic Viscosity (KV, units $mm^2/s$) and Brookfield Viscosity (BV, units cP) are determined employing ASTM methods D445 at 100° C. and 40 C and D2983 at −40° C. respectively. The viscosity index (VI) is also determined by employing the ASTM method D2270. The lubricating composition is also subjected to shear as ASTM D5621. The viscosity (100° C.) losses after the sonic shear are calculated to indicate the shear stability of the polymer. The data obtained is:

| | Polymer | Treat Rate (wt %) | BV −40 (1000's) | KV100 | V.I. | Loss after D5621 |
|---|---|---|---|---|---|---|
| LC4 | EX5 | 12.7 | 36 | 11.69 | 207 | −8.2% |
| LC5 | EX6 | 13.6 | 36 | 11.63 | 206 | −11% |
| CLC5 | CE4 | 12.7 | 37 | 11.46 | 197 | 10.2% |
| CLC6 | CE5 | 12.8 | solid | 11.28 | 206 | N.M. |

Solid = too thick to measure
N.M. = not measured as lubricant too thick

Overall the results indicate that the star polymer of the present invention has, relative to the comparative examples, at least one of acceptable viscosity index, acceptable fuel economy, acceptable low temperature viscometrics, acceptable oil-solubility, acceptable storage stability.

As described hereinafter the molecular weight of the viscosity modifier has been determined using known methods, such as GPC analysis using polystyrene standards. Methods for determining molecular weights of polymers are well known. The methods are described for instance: (i) P. J. Flory, "Principles of Polymer Chemistry", Cornell University Press 91953), Chapter VII, pp 266-315; or (ii) "Macromolecules, an Introduction to Polymer Science", F. A. Bovey and F. H. Winslow, Editors, Academic Press (1979), pp 296-312. As used herein the weight average and number weight average molecular weights of the polymers of the invention are obtained by integrating the area under the peak corresponding to the star polymer of the invention, which is normally the major high molecular weight peak, excluding peaks associated with diluents, impurities, uncoupled polymer chains and other additives.

As used herein, the term "hydrocarbyl substituent" or "hydrocarbyl group" is used in its ordinary sense, which is well-known to those skilled in the art. Specifically, it refers to a group having a carbon atom directly attached to the remainder of the molecule and having predominantly hydrocarbon character. Examples of hydrocarbyl groups include: hydrocarbon substituents, including aliphatic, alicyclic, and aromatic substituents; substituted hydrocarbon substituents, that is, substituents containing non-hydrocarbon groups which, in the context of this invention, do not alter the predominantly hydrocarbon nature of the substituent; and hetero substituents, that is, substituents which similarly have a predominantly hydrocarbon character but contain other than carbon in a ring or chain. A more detailed definition of the term "hydrocarbyl substituent" or "hydrocarbyl group" is described in paragraphs [0118] to [0119] of International Publication WO2008147704.

Unless otherwise indicated, each chemical or composition referred to herein should be interpreted as being a commercial grade material which may contain the isomers, by-products, derivatives, and other such materials which are normally understood to be present in the commercial grade. However, the amount of each chemical component is presented exclusive of any solvent or diluent oil, which may be customarily present in the commercial material, unless otherwise indicated.

It is known that some of the materials described above may interact in the final formulation, so that the components of the final formulation may be different from those that are initially added. The products formed thereby, including the products formed upon employing lubricant composition of the present invention in its intended use, may not be susceptible of easy description. Nevertheless, all such modifications and reaction products are included within the scope of the present invention; the present invention encompasses lubricant composition prepared by admixing the components described above.

Each of the documents referred to above is incorporated herein by reference. Except in the Examples, or where otherwise explicitly indicated, all numerical quantities in this description specifying amounts of materials, reaction conditions, molecular weights, number of carbon atoms, and the like, are to be understood as modified by the word "about." It is to be understood that the upper and lower amount, range, and ratio limits set forth herein may be independently combined. Similarly, the ranges and amounts for each element of the invention may be used together with ranges or amounts for any of the other elements.

While the invention has been explained in relation to its preferred embodiments, it is to be understood that various modifications thereof will become apparent to those skilled in the art upon reading the specification. Therefore, it is to be understood that the invention disclosed herein is intended to cover such modifications as fall within the scope of the appended claims.

What is claimed is:

1. A lubricating composition comprising an oil of lubricating viscosity and a star polymer, wherein the star polymer comprises a core bonded to at least two inner blocks, at least one of which in turn is bonded to one or more outer blocks, wherein at least one inner block consists essentially of:

(a) 23 wt % to 38 wt % of a methyl methacrylate-derived unit, (b) 63 wt % to 75 wt % of a $C_{12-15}$-alkyl methacrylate-derived unit different from (a), wherein the (meth)acrylate alkyl group of the inner block has a number average number of carbons of 5.6-7.7; and wherein at least one outer block consists essentially of:

(a) 80 wt % to 90 wt % of a $C_{12-15}$-alkyl methacrylate-derived unit, and (b) 10 wt % to 20 wt % of methyl methacrylate-derived unit different from (a) and wherein the outer block is different from the inner block, wherein the (meth)acrylate alkyl group of the outer block has a number average number of carbons of 8.2 to 11.9; and wherein the difference in the number average number of carbon atoms between the alkyl groups of the inner block and the alkyl groups of the outer block is between 2 and 5;

wherein the number average number of carbon atoms in the alkyl groups of the inner block is less than the average number of carbon atoms in the alkyl groups of the outer block, and wherein the star the ratio of the inner block to the outer block is 20:80 to 80:20 by weight.

2. The lubricating composition of claim 1, wherein the star polymer is derivable from a free radical polymerisation or a controlled free radical polymerisation.

3. The lubricating composition of claim 2, wherein the controlled free radical polymerisation includes RAFT, or ATRP, or nitroxide-mediated polymerisation.

4. The lubricating composition of claim 1 further comprising at least one of a dispersant, an antiwear agent, a dispersant viscosity modifier, a friction modifier, a viscosity modifier, an antioxidant, an overbased detergent, an extreme pressure agent, or mixtures thereof.

5. The lubricating composition of claim 1 further comprising at least one of a polyisobutylene succinimide dispersant, an antiwear agent, a dispersant viscosity modifier, a friction modifier, a viscosity modifier, an antioxidant, an overbased detergent, an extreme pressure agent, or mixtures thereof.

6. The lubricating composition of claim 1 further comprising an overbased detergent, a dispersant, and an antiwear agent.

7. The lubricating composition of claim 1 further comprising an antiwear agent and a corrosion inhibitor.

8. The lubricating composition of claim 1 further comprising a phosphorus-containing acid, salt, or ester, and a dispersant.

9. The lubricating composition of claim 1 further comprising a phosphorus-containing acid, salt, or ester, and an extreme pressure agent other than a phosphorus-containing acid, salt, or ester.

10. A method of lubricating a mechanical device comprising supplying to the mechanical device a lubricating composition of claim 1, wherein the mechanical device is an internal combustion engine, a hydraulic device, a manual or automatic transmission, an industrial gear, an automotive gear or axle, or a farm tractor.

11. The lubricating composition of claim 1, wherein the star polymer comprises at least 25% of the polymer arms having at least one inner block bonded to at least one outer block.

12. The lubricating composition of claim 1, wherein the star the ratio of the inner block to the outer block is 75:25 to 50:50 by weight.

* * * * *